US007428760B2

(12) United States Patent
McCrimmon

(10) Patent No.: US 7,428,760 B2
(45) Date of Patent: Sep. 30, 2008

(54) LIFTING MECHANISM AND HEALTH CARE EQUIPMENT THAT INCORPORATES THE LIFTING MECHANISM

(75) Inventor: Barry Edward McCrimmon, Frankston (AU)

(73) Assignee: Protean Global Pty Ltd, Victoria (AU)

( * ) Notice: Subject to any disclaimer, the term of this patent is extended or adjusted under 35 U.S.C. 154(b) by 58 days.

(21) Appl. No.: 10/505,810

(22) PCT Filed: Feb. 6, 2003

(86) PCT No.: PCT/AU03/00119

§ 371 (c)(1),
(2), (4) Date: May 25, 2005

(87) PCT Pub. No.: WO03/070145

PCT Pub. Date: Aug. 28, 2003

(65) Prior Publication Data

US 2005/0223491 A1 Oct. 13, 2005

(30) Foreign Application Priority Data

Feb. 25, 2002 (AU) ..... PS0746

(51) Int. Cl.
*A47B 7/00* (2006.01)
*A47C 31/00* (2006.01)

(52) U.S. Cl. ..... 5/611; 5/11

(58) Field of Classification Search ..... 5/611, 5/618, 610, 11; 248/125.2; 108/147
See application file for complete search history.

(56) References Cited

U.S. PATENT DOCUMENTS 1,778,698 A 10/1930 Walter
3,041,120 A * 6/1962 Burzlaff et al. ..... 5/614
4,191,276 A 3/1980 Farmer et al.
5,337,430 A 8/1994 Schlein
5,682,825 A * 11/1997 Manner ..... 108/147
5,809,908 A * 9/1998 Catta et al. ..... 108/147
6,253,396 B1 7/2001 Weston
6,505,365 B1 * 1/2003 Hanson et al. ..... 5/613

FOREIGN PATENT DOCUMENTS

AU A-81153/91 1/1992
DE 4405508 8/1995

(Continued)

*Primary Examiner*—Patricia Engle
*Assistant Examiner*—Jonathan J Liu
(74) *Attorney, Agent, or Firm*—The Webb Law Firm

(57) ABSTRACT

Disclosed is a mechanism for raising and lowering a patient support including a base having two spaced posts extending upwardly, a sliding sleeve on each base post and a cross member fixed to and extending between the sleeves. An actuator is located between the base and the cross member to move the cross member vertically with respect to the base. A horizontal member located above the cross member is slidingly moveable with respect to the sleeves and includes guides to capture the sleeves. A pulley is provided on the cross member and supports a chain or belt, fixed to the base at a first end and at the other end to the horizontal support. As the actuator raises and lowers the cross member, the upper support is raised and lowered at a greater speed. On the base is a reversible fold down pole to assist the patient in raising and lowering themselves.

15 Claims, 15 Drawing Sheets

FOREIGN PATENT DOCUMENTS

| | | |
|---|---|---|
| DE | 298 02 116 U1 | 7/1999 |
| FR | 2 769 498 | 4/1999 |
| RU | 1777861 A1 | 11/1992 |
| WO | WO 98/20829 | 5/1998 |
| WO | WO 00/33784 | 6/2000 |
| WO | WO 01/45626 A1 | 6/2001 |

* cited by examiner

LIFTING MECHANISM AND HEALTH CARE EQUIPMENT THAT INCORPORATES THE LIFTING MECHANISM

BACKGROUND OF THE INVENTION

1. Field of the Invention

The invention relates to a lifting mechanism adapted for use in a wide range of applications.

One particular, although by no means the only, application for the lifting mechanism of the invention is in the field of health care equipment to raise and lower patients. Accordingly the invention also relates to health care equipment that incorporates the lifting mechanism.

In particular, the invention relates to a pedestal lifting mechanism located at the head and foot of a height-adjustable bed, such as a hospital bed, to raise and lower a bed mattress base.

The invention also relates to a reversible, fold-down patient self-assist pole to be fitted to health care equipment.

The following discussion focuses on health care equipment. However, it is noted that the invention is not limited to this application.

2. Description of the Related Art

Lifting devices for lifting patients and invalids are extremely useful features of health care equipment such as hospital beds, transporting trolleys, wheelchairs, and the like. Incorporating this kind of vertical mobility into health care equipment eases the burden on health care staff in moving patients.

For example, a lifting mechanism on a hospital bed enables the bed mattress supporting a patient to be raised to a height equal to an operating theatre trolley for transferring the patient from the bed to the trolley. The same bed may also be lowered to a height low enough for the patient to lower him or herself out of bed without assistance.

Some lifting mechanisms used in the above described health care equipment are operated by a linear actuator mounted between a stationary base and a movable horizontal cross member, where the cross member is attached to a person support, such as a chair base or a mattress base, supporting a patient. Owing to the large forces involved in supporting a person, as well as the weight of the equipment, the lifting mechanism must necessarily be sufficiently robust to withstand the forces and moments during operation. Additionally, the lifting mechanism should be well balanced to avoid creating further moments and imbalances in the equipment.

Consequently, the lifting mechanisms are usually bulky and intrusive structures that are difficult to pack, transport and assemble.

SUMMARY OF THE INVENTION

With the present invention it is intended to provide a lifting mechanism that operates in an efficient manner and that is less intrusive than known lifting mechanisms.

According to the present invention there is provided a lifting mechanism, for example for use in health care equipment for raising and lowering patients on a patient support, the lifting mechanism comprising:

(a) a base to which at least two spaced base posts are mounted to extend upwardly;

(b) a sleeve slidable on each base post;

(c) a cross member located between the sleeves and fixed thereto;

(d) an actuator located between the base and the cross member and adapted to vertically move the cross member relative to the base;

(e) an upper support member for an object to be lifted slidingly movable along the sleeves; and (f) a pulley provided on the cross member, the pulley supporting a chain or belt fixed at a first end to the base and at the other end to the upper support member so that, in use, as the actuator raises and lowers the cross member the upper support member is respectively raised or lowered at a greater speed than the cross member.

In one embodiment the sleeves include channels and the upper support member includes guides that are received in the channels for sliding movement along the sleeves.

In another, although not the only, other embodiment the sleeves are captured in guides located on the upper support member.

Preferably the lifting mechanism further comprises a lower support member for an object mounted to and movable with the sleeves so that, in use, as the actuator raises and lowers the cross member the lower support member is respectively raised or lowered at the same speed as the cross member.

In use of the above-described arrangement, during raising or lowering, the upper and lower support members move closer or further apart.

This relative upward and downward movement of the upper and lower support members makes the lifting mechanism suitable for use in a wide range of applications where differential lifting and lowering rates are required.

For example, one health care application is to facilitate moving patients from horizontal to sitting positions and supporting the patients in the sitting position by using the upper support member (for example via a sling) to support the torso of a patient and the lower support member (for example via a sling) to support the lower body of the patient. With this arrangement, operating the lifting mechanism results in the upper support member lifting the torso of the patient at a faster speed than the lower support member, with the result that the patient is moved to a sitting position as the patient is lifted upwardly.

Preferably the lifting mechanism includes wheels to allow the lifting mechanism to be moved from one location to another location.

Preferably the lifting mechanism is adapted to support an object in a stable and safe manner in a raised position while the object is being lifted and thereafter moved from one location to another location.

According to the invention there is also provided health care equipment that includes a lifting mechanism comprising:

(a) a base to which at least two spaced base posts are mounted to extend upwardly;

(b) a sleeve slidable on each base post;

(c) a cross member located between the sleeves and fixed thereto;

(d) an actuator located between the base and the cross member and adapted to vertically move the cross member relative to the base;

(e) an upper support member slidingly movable along the sleeves; and (f) a pulley provided on the cross member, the pulley supporting a chain or belt fixed at a first end to the base and at the other end to the upper support member so that, in use, as the actuator raises and lowers the cross member the upper support member is respectively raised or lowered at a greater speed.

In one embodiment the sleeves include channels and the upper support member includes guides that are received in the channels for sliding movement along the sleeves.

In another, although not the only, other embodiment the sleeves are captured in guides located on the upper support member.

Preferably the lifting mechanism further comprises a lower support member mounted to and movable with the sleeves so that, in use, as the actuator raises and lowers the cross member the lower support member is respectively raised or lowered at the same speed as the cross member.

In one embodiment the upper support member is adapted to be attached to a primary patient support.

Preferably the patient support to which the upper support member is attached is a primary support for a patient.

In one embodiment the lower member is adapted to be attached to a secondary patient support.

In one embodiment the health care equipment is a height-adjustable bed having:

(a) a first bed end and a second bed end, each bed end comprising the lifting mechanisms; and (b) a mattress support provided between the bed ends and mounted to the upper support members of the lifting mechanisms of the bed ends, wherein the mattress support is the primary patient support and is vertically moveable relative to the bed ends.

Preferably the secondary patient support is a lower bed support frame which adds stability to the bed by creating a box frame with the primary support and the lifting mechanisms at each end of the bed.

Preferably the primary and secondary patient supports are parallel.

In use, during raising or lowering, the primary and secondary patient supports, which are parallel, move closer or further apart such that, for example, as the lifting mechanism raises, the primary and secondary patient supports move apart forming a stable box frame.

The lifting mechanism ends of the bed are preferably independently operable such that one lifting mechanism may be raised to a different height to the lifting mechanism at the other end of the bed.

In order to accommodate the tilt of the bed ends as a result of the inclined patient support, the base is preferably provided with castor wheels.

Furthermore, preferably each guide includes a means to accommodate tilting movement of the patient support.

For example, in the case of the embodiment in which the sleeves include channels that receive the guides for sliding movement along the sleeves, the guides at least on one one bed end include pivotally mounted links to accommodate tilting movement of the patient support.

By way of further example, in the case of the embodiment in which the sleeves are captured in guides located on the upper support member, the guides have a concave surface that allows the guides freedom to rotate on the sleeves thereby allowing for the relative movement between the sleeves and primary support when the lifting mechanisms at each end of the bed are adjusted to different heights.

The invention further provides a reversible, fold-down patient self-assist pole to be fitted to health care equipment, the equipment having receiving means to receive the lifting arm, the self-assist pole comprising:

(a) an angled bar having a first section adapted to be inserted into the receiving means and secured thereto and a second section perpendicular to the first section;

(b) a handlebar with an attachment sleeve at one end through which is received the second section of the angled bar, wherein the sleeve and second section are shaped in cross-section to prevent the sleeve, and thus the handlebar, rotating about the second section; and (c) the second section being provided at its end with a coaxially aligned third section which is shaped in cross-section to allow the sleeve, and thus the handlebar, to rotate around the third section thereby enabling the orientation of the handlebar relative to the angled bar to be changed by sliding the handlebar along the second section onto the third section, rotating the handlebar around the third section to a new orientation and sliding the handlebar back onto the second section with the handle orientated in a new direction.

Preferably the health care equipment is a height-adjustable bed.

Preferably the cross-section shape of the second section and the sleeve are square whereas the shape of the cross-section of the third section is round.

Furthermore, the cross-section of the first section is also preferably square and is received in a square receiving means to secure the lifting arm to the equipment.

The handlebar is preferably pivotably connected to the sleeve such that the angle of the handlebar relative to the second section can be adjusted.

The sleeve preferably includes a clamping means to enable the handlebar to be clamped to the second section at a desired point.

The end of the third section is preferably provided with a stop to prevent the handlebar from sliding off the third section.

BRIEF DESCRIPTION OF THE DRAWINGS

The invention is described further by way of example with reference to the accompanying drawings by which.

DETAILED DESCRIPTION OF THE INVENTION

The invention relates to a lifting mechanism, which is described in the following preferred embodiment shown in FIGS. 1 to 12 in the context of health care equipment in the form of a height-adjustable bed, typically a hospital bed. The invention is not limited to this application.

Figure 1:
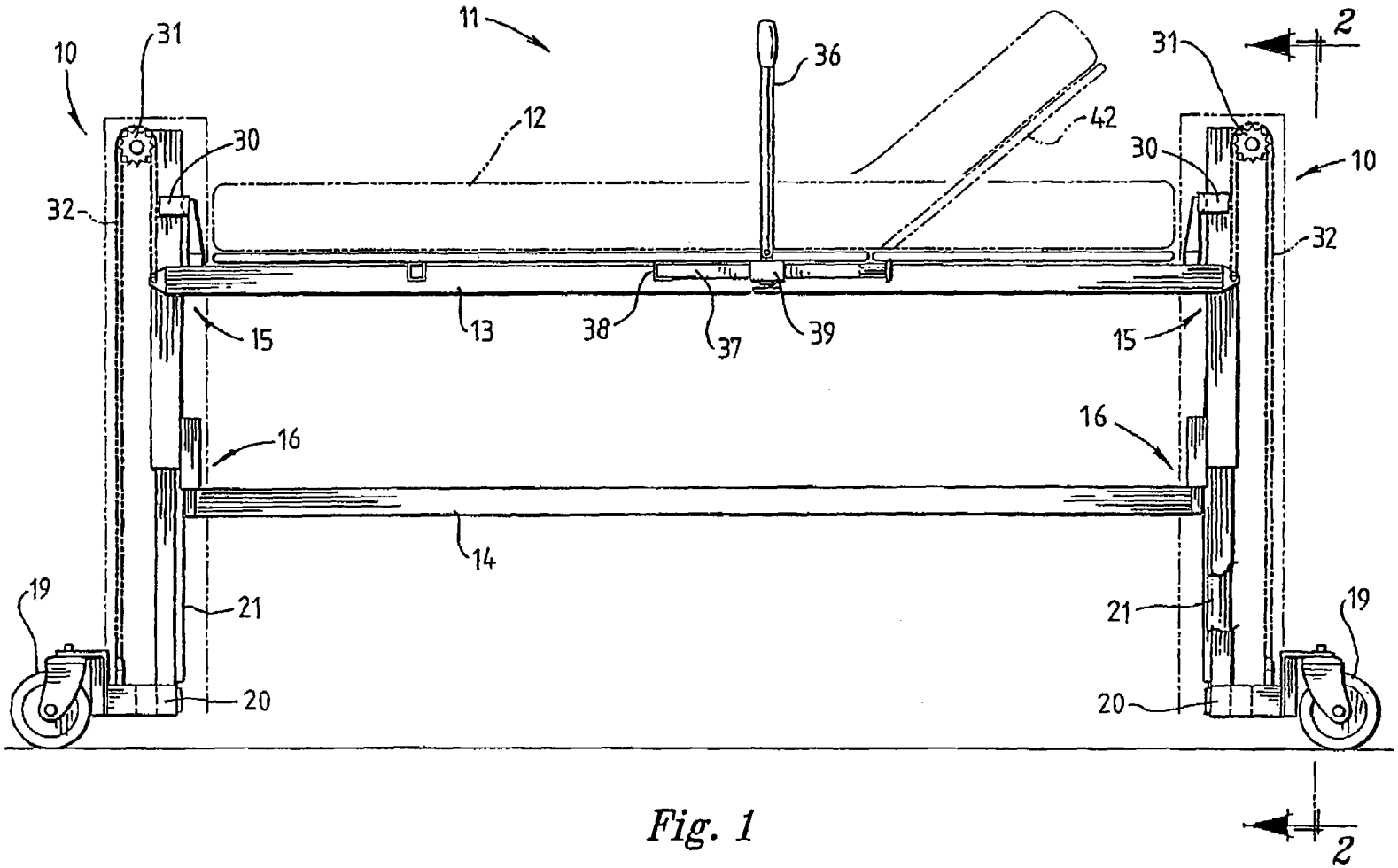
FIG. 1 is a side view of a bed incorporating a lifting mechanism and a reversible, fold-down patient self-assist pole arm in accordance with one embodiment of the invention with the lifting mechanism raised to a maximum height.
Figure 11:
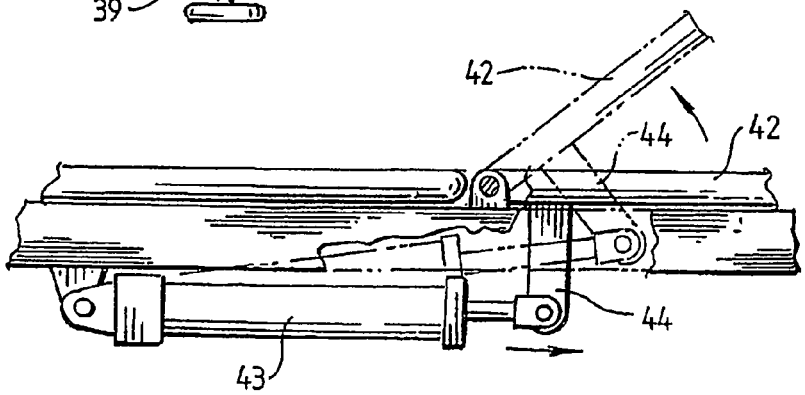
FIG. 11 illustrates the means for pivoting a section of the mattress base.
Figure 12:
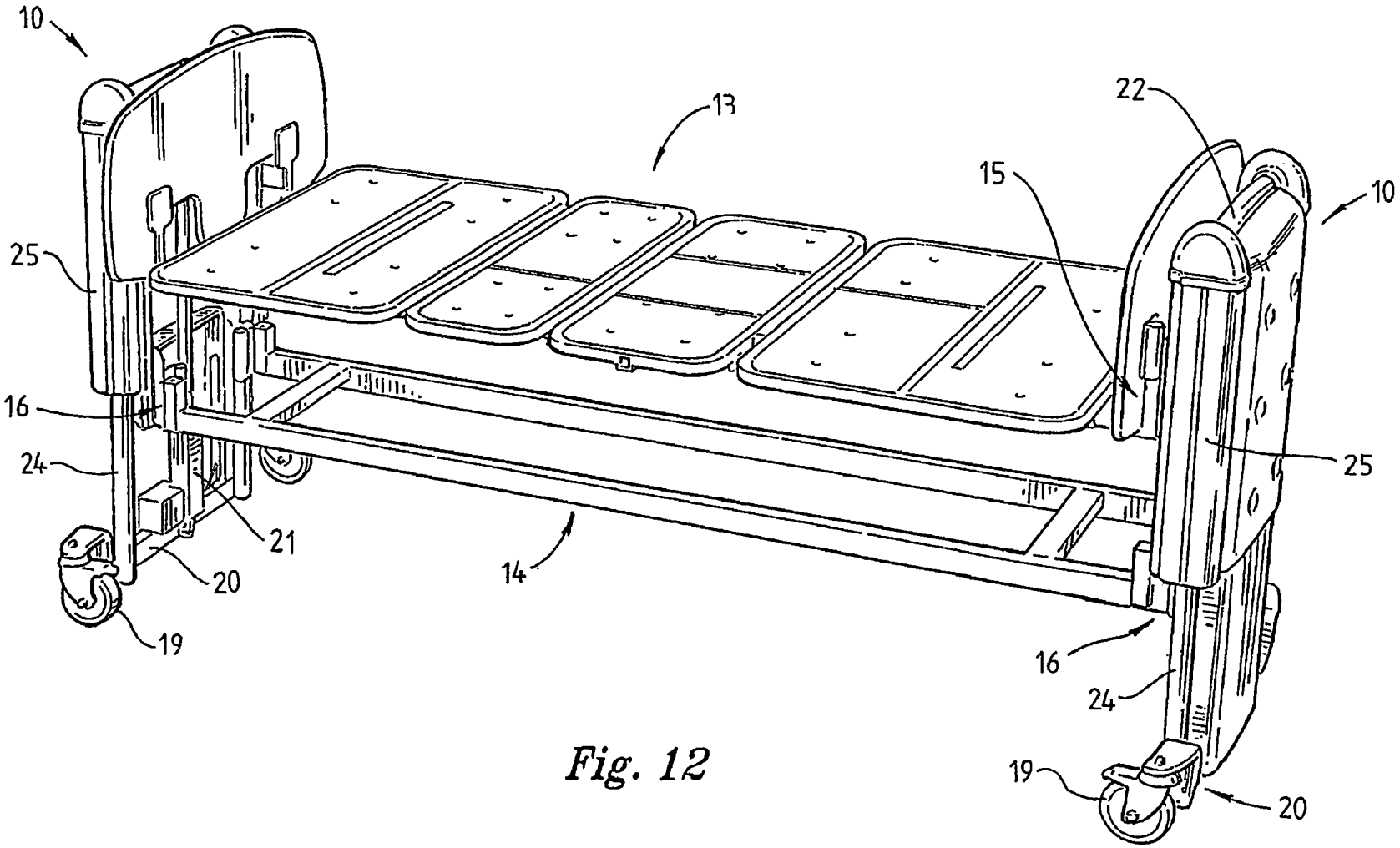
FIGS. 12 to 14 are perspective views from different positions of a bed incorporating a lifting mechanism in accordance with another embodiment of the invention with the lifting mechanism raised to a maximum height.
Figure 13:
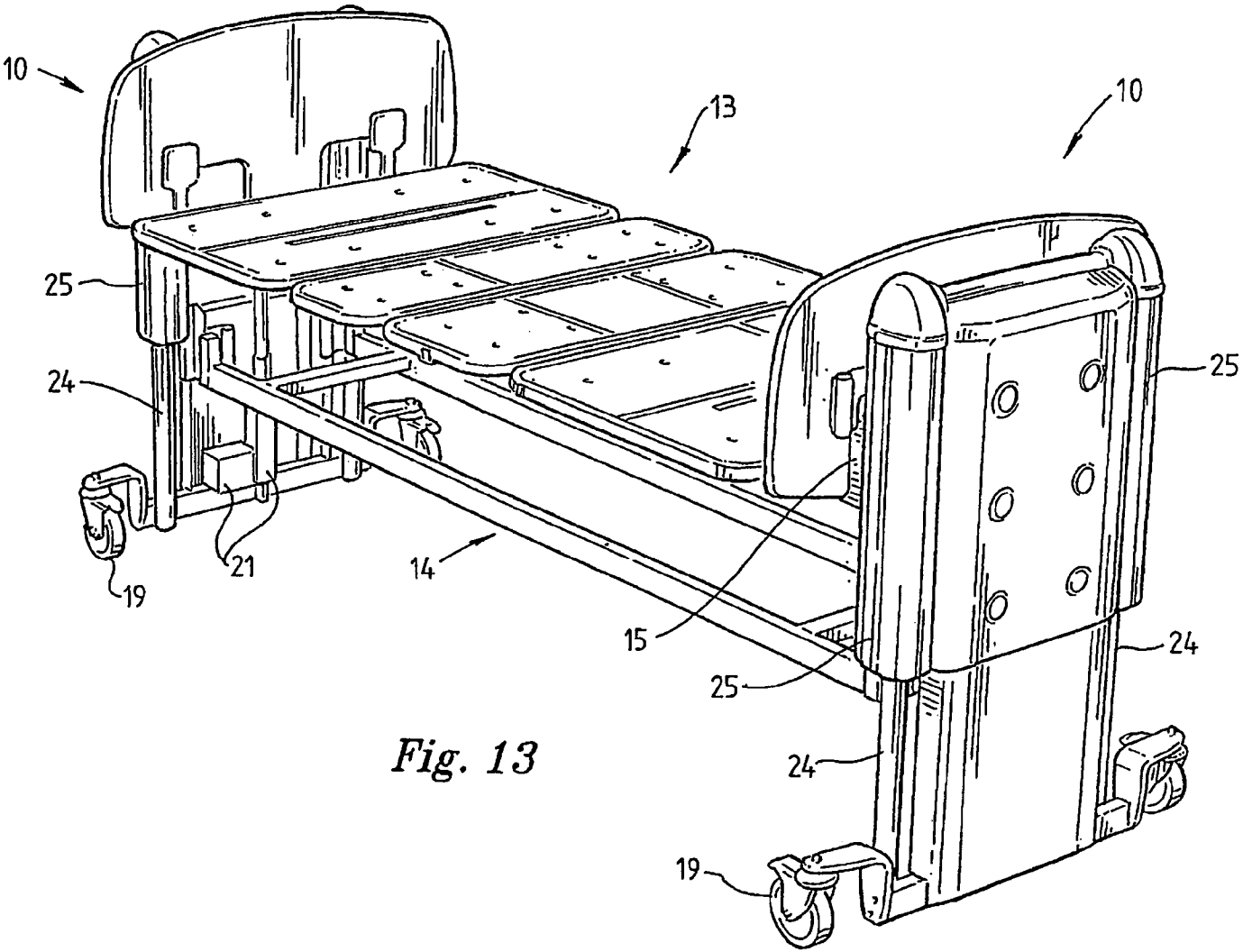
Figure 14:
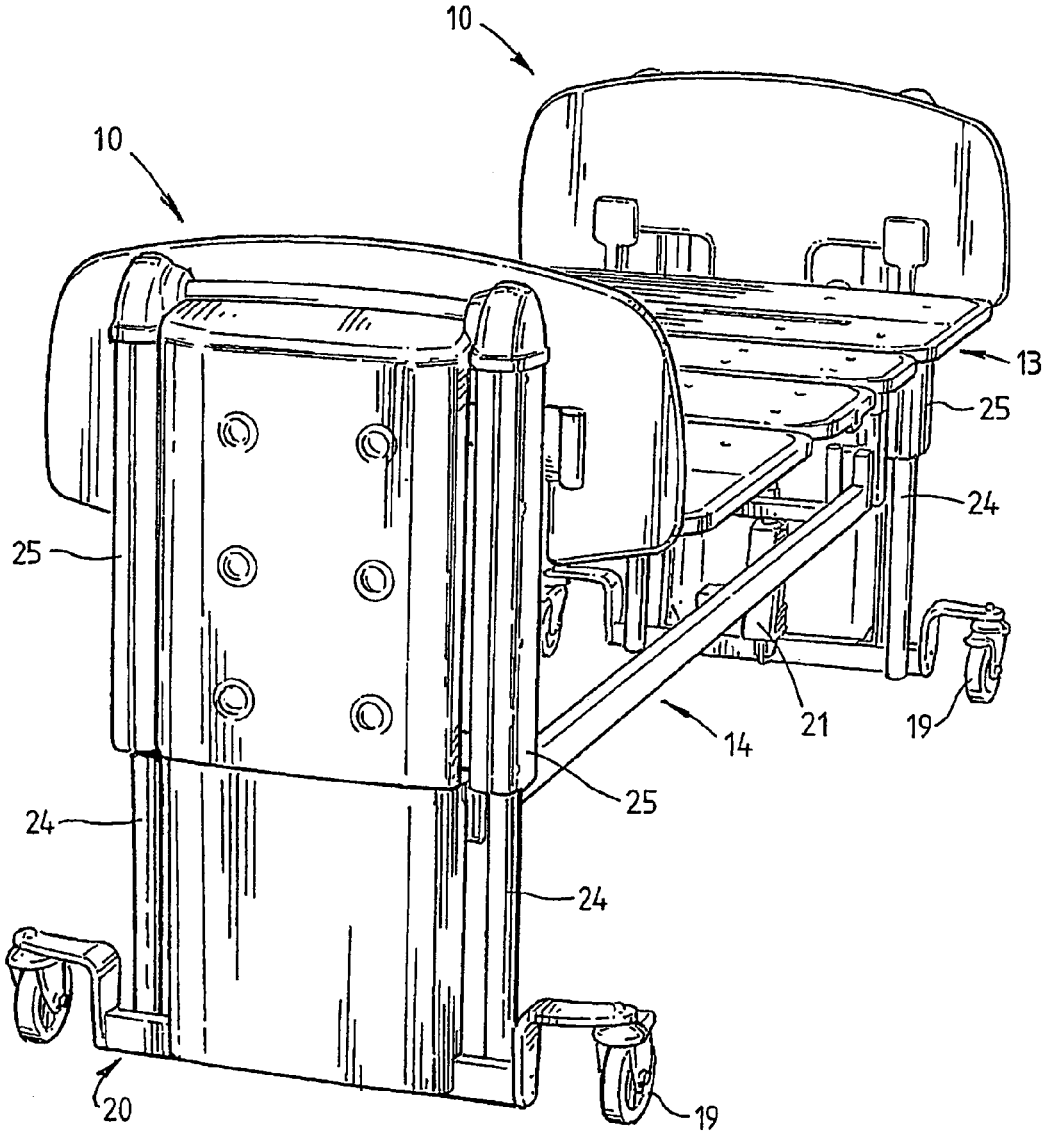

Such a bed includes a mattress base positioned between two pedestal ends between which the mattress base may be raised or lowered. The bed may also feature, as illustrated in FIG. 1, a section 42 of the mattress base pivotally attached to the rest of the base so as to allow the section to tilt upwardly and serve as a backrest for a person lying in bed. A pump 43 located under the mattress base is usually used to operate the pivoting. FIG. 11 is a closer view of the pump and lever 44 used to pivot section 42 upwards.

In the present embodiment the mattress base is defined by an upper frame 13. The bed also includes a lower frame 14 spaced below the upper frame as illustrated in FIG. 1. In this embodiment two lifting mechanisms 10 are provided, one at each end of the bed 11 defining a pedestal lifting mechanism arrangement for the bed. The bed mattress 12 is placed on the upper frame 13. The upper and lower frames are connected to corresponding horizontal support members, 15 and 16 respectively, provided on the lifting mechanism and moveable in the vertical direction.

Figure 2:
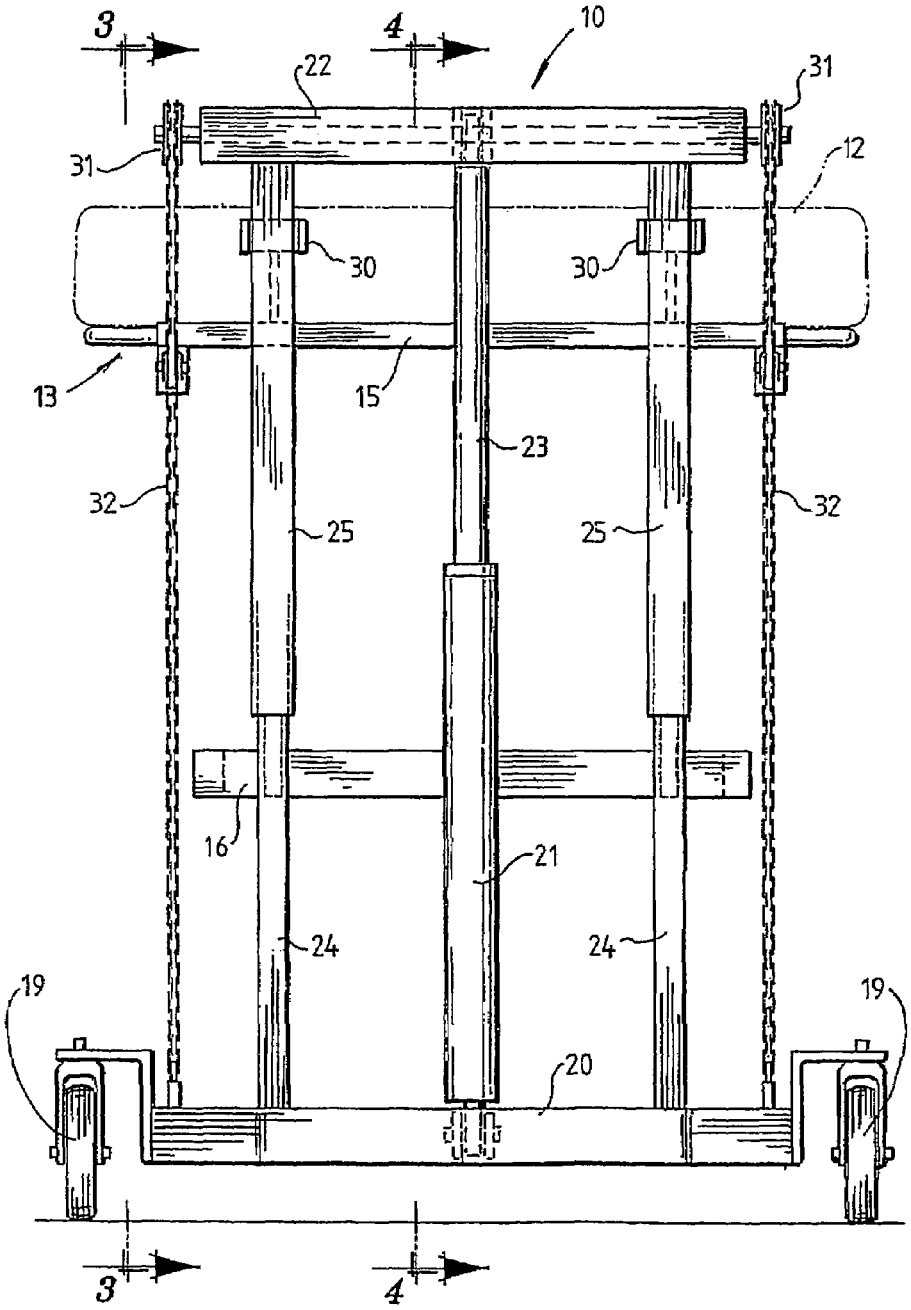
FIG. 2 is an end view of the lifting mechanism taken at arrow 2-2 in FIG. 1.
Figure 3:
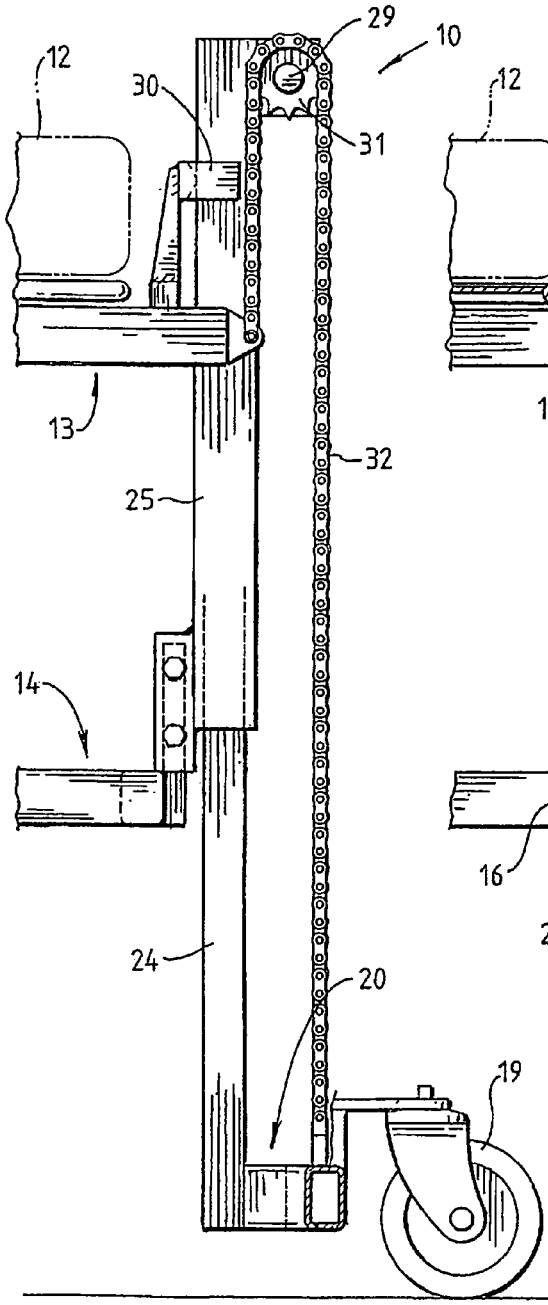
FIG. 3 is a side view of the lifting mechanism taken at arrow 3-3 in FIG. 2.
Figure 4:
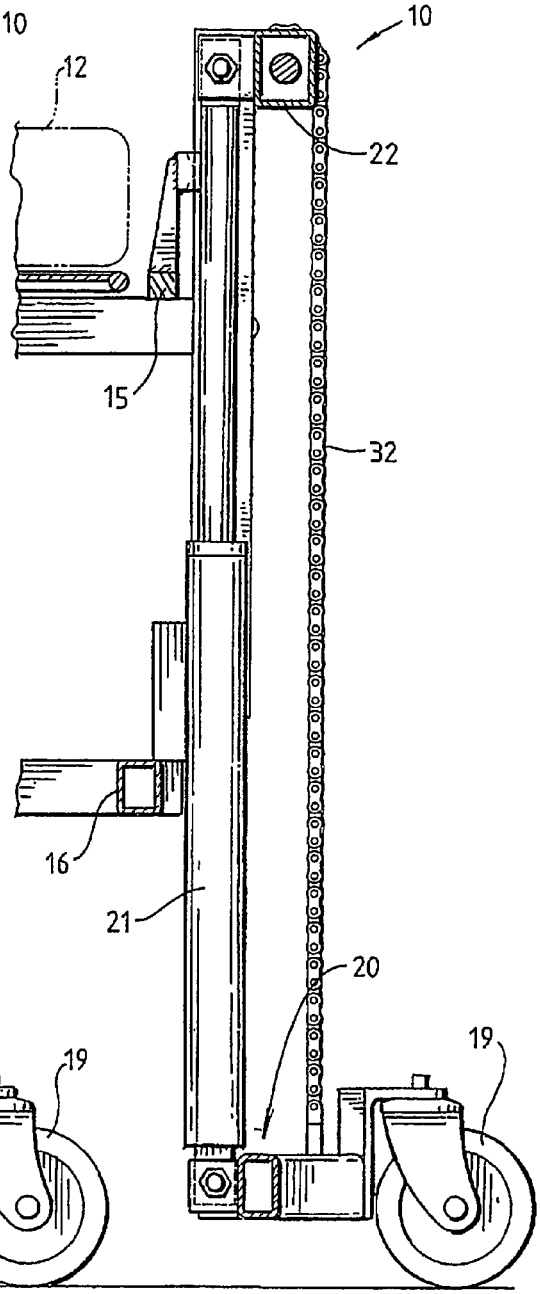
FIG. 4 is a side sectional view of the lifting mechanism taken at arrow 4-4 in FIG. 2.
Figure 5:
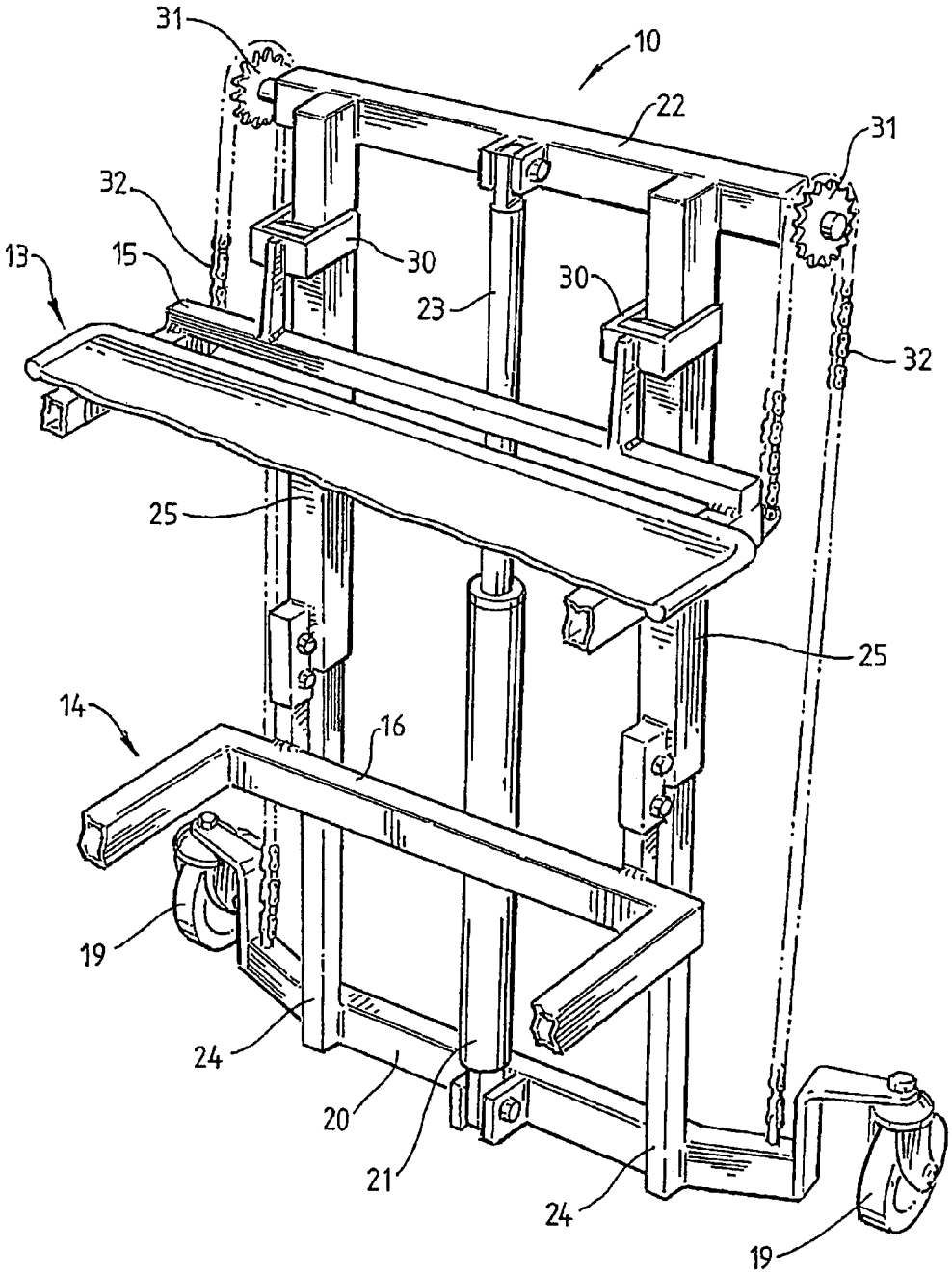
FIG. 5 is a perspective view of the lifting mechanism.

FIG. 2 illustrates a pedestal lifting mechanism 10 comprising a stationary base 20 mounted on two castor wheels 19 and a linear actuator 21 mounted on the base. The other end of the linear actuator is attached to a cross member 22 which, as the actuator piston 23 moves upwards, is pushed upwards sliding on two base posts 24 mounted upright and spaced apart on the base 20. Post sleeves 25, at the top of which the cross member extends between and is fixed directly to, slide on the base posts 24 thereby raising and lowering the cross member. As illustrated in FIGS. 3 to 5 the lower support member 16 is also attached to the post sleeves 25, and specifically towards the lower end of the sleeves, so that as the sleeves slide along the base posts the lower support member slides at the same rate and direction as the cross member. The upper support member 15 on the other hand, slides along the post sleeves themselves by way of plastic C-section guides in which the post sleeves 25 are captured.

In the present embodiment incorporating two lifting mechanisms defining the pedestal ends of a bed, the actuators are wired to operate simultaneously as well as independently, depending on the positioning required of the person.

Specifically, the bed includes a control box mounted to the actuator at the head end of the bed. The control has a 240V input that is transformed to 24V and has 4 outlet ports. Two of the outlet ports are connected to the actuators and power the actuators. One of the other outlet ports is connected to a hand-held push-button controller that facilitates control of the various lifting mechanism functions.

Pulleys, and specifically sprockets 31, located at the ends of the cross member 22 move upwards with the cross member as the linear actuator moves the cross member and lower support member upwards. A chain linkage 32 extending around each sprocket has one end fixed to the stationary pedestal base 20 and the other fixed to the upper support member 15 to which the upper bed frame is attached.

As the actuator 21 operates to extend upwardly it raises the cross member 22 and the lower support member 16 and consequently the lower frame 14. The sprockets 31 located on the cross member are also raised thereby causing the chains to rotate over the sprockets. Because one end of each chain is secured to the stationary base 20, the other end consequently begins to move upwardly lifting with it the upper support member 15, to which the other end is attached, and hence the upper bed frame 13.

The lifting mechanism 10 comprising the linear actuator and two post pulley system operates to raise the lower bed frame 14 at the same speed and distance as experienced by the actuator piston 23 whilst, as a result of the pulley system, the upper bed frame 13 is raised at twice the speed and therefore twice the height. This allows a person on a mattress base on the upper frame to be lifted to a desired height in half the time taken by a regular actuator. The bed frame in its lifted position forms a stable box frame, defined by the upper and lower frames and end pedestals. This allows the lifting mechanism to be operated by an actuator having a considerably shorter piston than regular actuators owing to the stability provided by the box frame where the lower centre of mass of the bed allows for a significantly shorter lifting mechanism. Accordingly, pedestal lifting mechanism 10 need only be approximately the same height as the height of the upper frame in its minimum raised position.

Transportation of patients is easier with the present lifting mechanism and there is less chance of the equipment tipping than with conventional beds. Additionally, the lifting mechanism is economically manufactured with less material required owing to its shorter structure. The bed unit can be classified as a "knock-down" unit in that it can be easily disassembled, transported and reassembled. The structural advantage of the box frame reduces moments created on the bed frame under uneven loads thereby increasing the structural integrity of the unit. Stability is further increased by preventing relative movement of the sprockets by linking the sprockets through a horizontal shaft 29 (see FIG. 17) extending through the hollow cross member 22.

Figure 6:
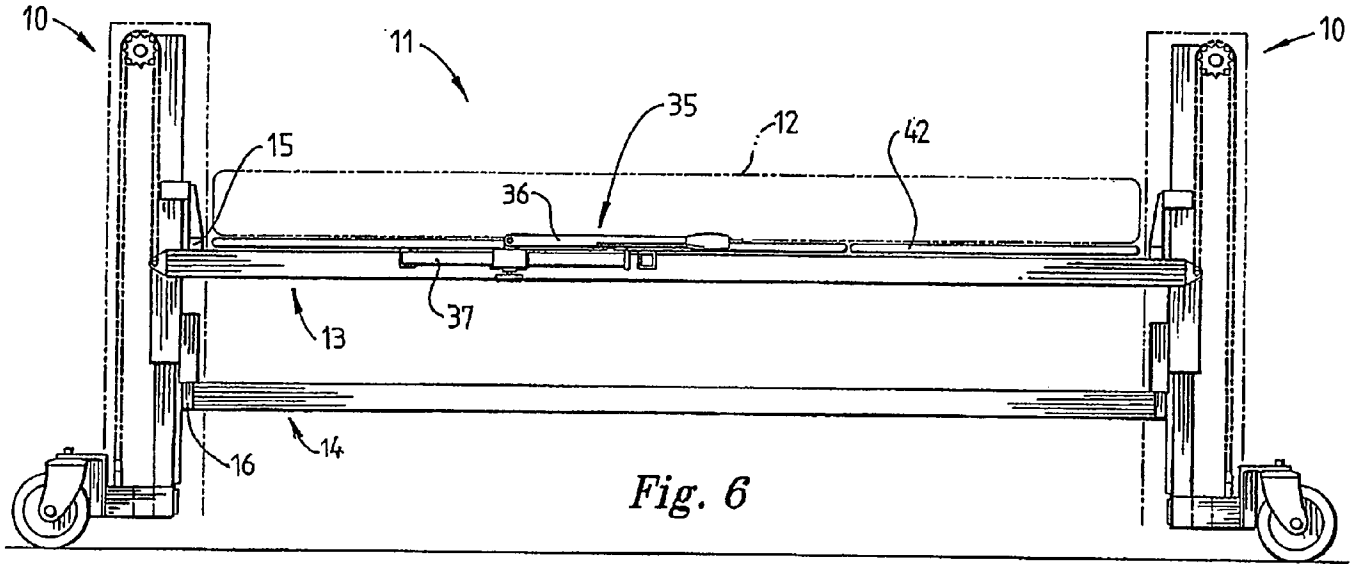
FIG. 6 is a side view of a bed incorporating the lifting mechanism with the lifting mechanism raised to mid-height.
Figure 7:
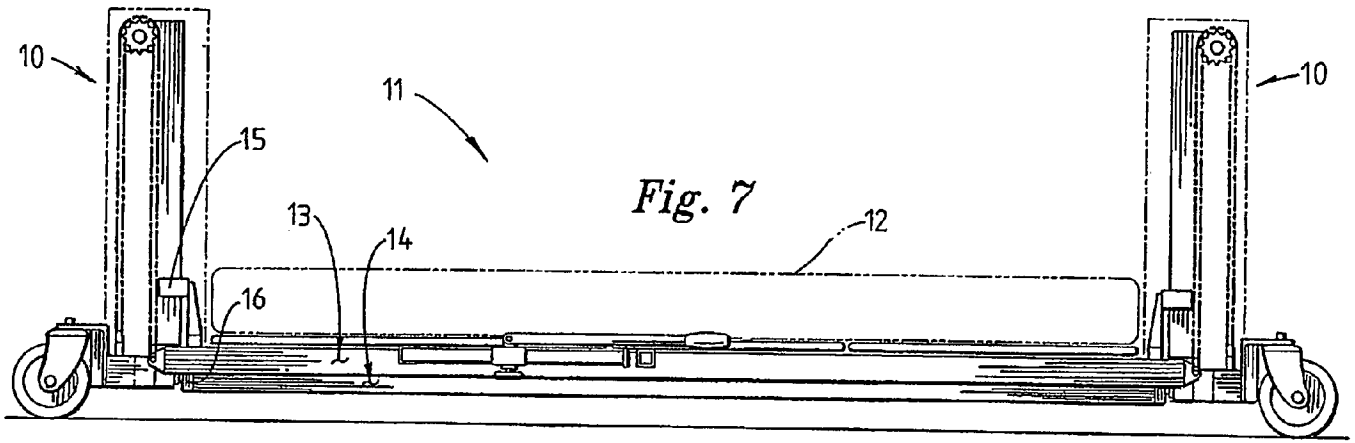
FIG. 7 is a side view of a bed incorporating the lifting mechanism with the lifting mechanism lowered to a minimum height.

The present lifting mechanism also allows the upper bed frame 13 to be lowered very close to the lower bed frame 14 and very low to the ground which may at times be useful in lifting patients in some situations. FIGS. 6 and 7 illustrate the upper and lower bed frames at mid-height and almost touching the ground. In fact, the upper frame can be lowered to the same level as the lower frame if the frames are designed to fit one inside the other.

Figure 8:
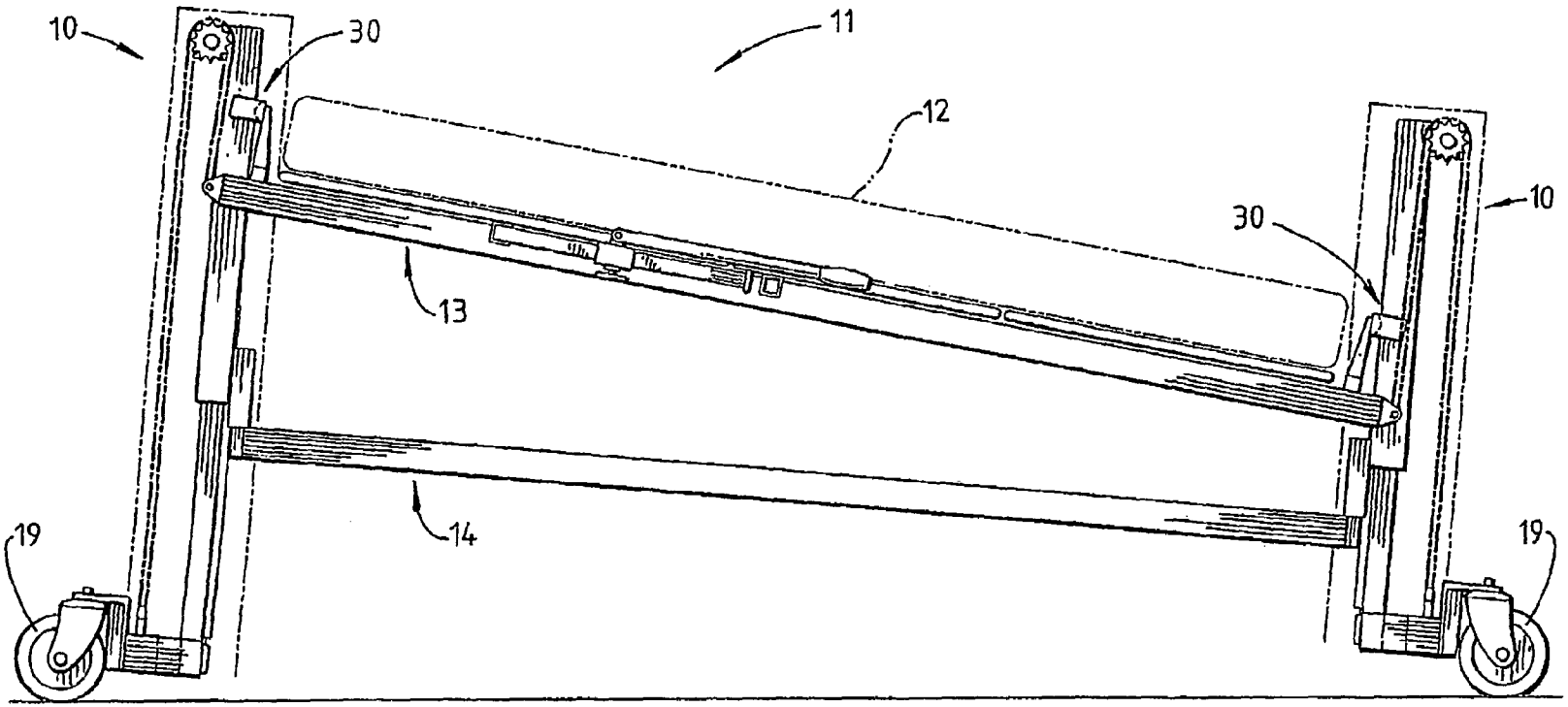
FIG. 8 is a side view of a bed incorporating the lifting mechanism with the lifting mechanisms at each end of the bed raised to different heights.

The lifting mechanism can further compensate against tilting forces where a difference in height between pedestal lifting mechanisms on a bed unit, experienced when one end of a patient is raised higher than the other, causes the lifting mechanism to tilt from a vertical position. This is brought about by operating the actuators independently of one another to tilt the upper and lower frames relative to the pedestals, as illustrated in FIG. 8. Uneven load distribution on the bed frame is electrically compensated by compensating for the amperage drawn on one actuator with the other actuator. With the present lifting mechanism the bed unit remains stable and free from structural stresses partly because the pedestal ends are free to pivot at the castors, which are pivotally attached to the base, but moreover jamming of the lifting mechanism does not occur owing to a clearance provided between the C-section guides and the sliding post sleeves. Alternatively, the guides can be replaced by convexly curved bushings (see FIG. 3) which are designed to evenly contact the sliding post sleeves 25 as the frame is tilted thereby preventing point loading on the guides.

Hospital beds are frequently provided with poles to assist patients in raising and lowering themselves on the bed. The poles are generally connected to a crossbar that slides into a fixed sleeve attached to the underside of the mattress frame.

A further feature of the present invention is a reversible pole that can be readjusted for use on either side of the bed with the patient oriented in either direction on the bed.

Figure 9:
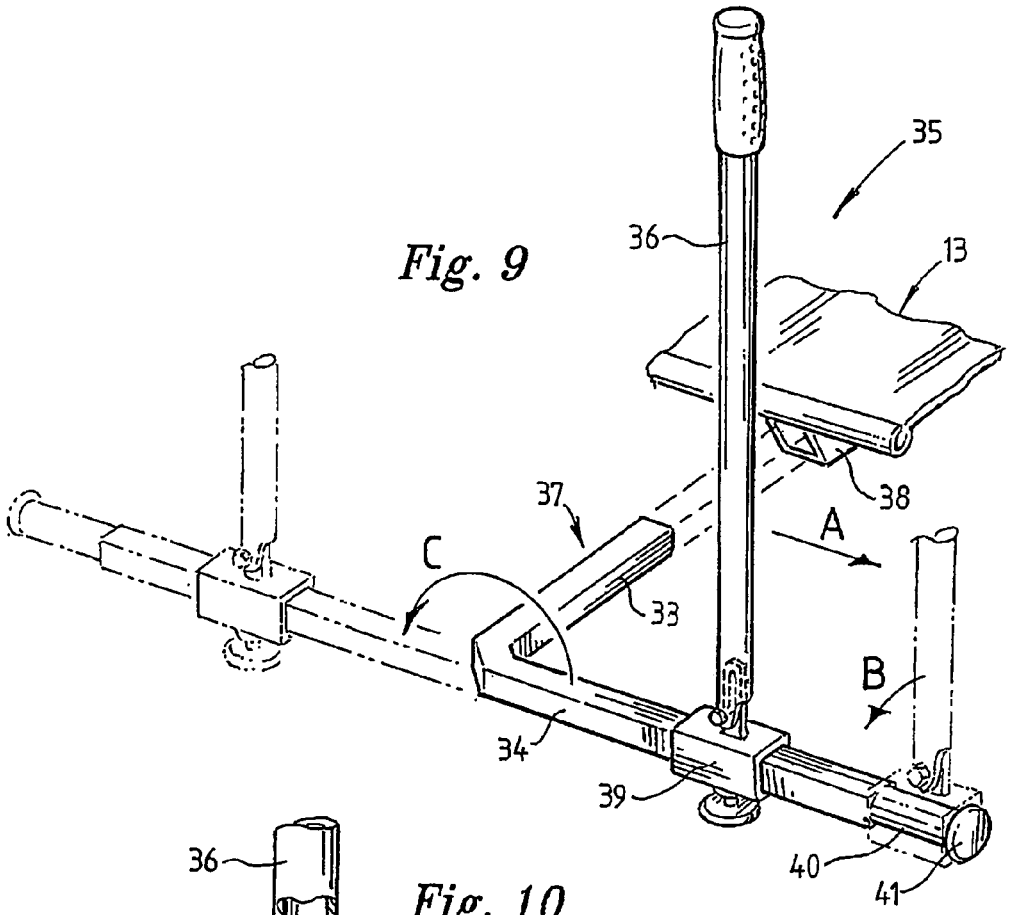
FIG. 9 illustrates a lifting pole in accordance with the present invention fitted along the side a bed.
Figure 10:
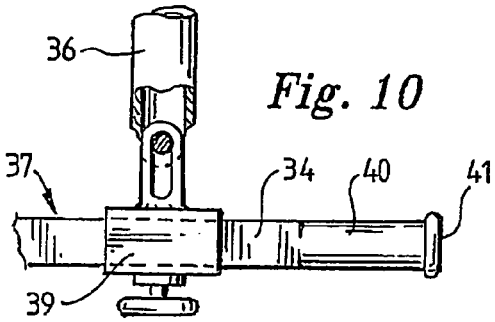
FIG. 10 is a side view of part of the lifting pole.

The reversible pole arrangement 35 is illustrated in FIGS. 9 and 10 and includes a handlebar 36 moveable on an angled bar 37 but not detachable from the angled bar. The angled bar has a first portion 33 adapted to be inserted in the sleeve 38 attached to the underside of the bed. The angled bar is clamped into the sleeve. The handlebar 36 is slidable along a second portion 34 of the angled bar 37 in the direction of arrow A in FIG. 9 by way of a sliding sleeve 39 to which it is pivotally attached. The handlebar is clamped onto the second portion 34 of the angled bar 37 with a screw and maintains an upright position for grabbing by a patient by virtue that both the sliding sleeve 39 and second portion 34 are square in cross section and therefore unable to rotate concentrically.

In order to reorientate the handlebar so that it can be used from another side or end of the bed the handlebar is slid along the square section of the angled bar to a third section 40 coaxially aligned with the section and which is round in cross section such that the handlebar can be rotated in the direction of arrow B and slid back on to the square section in a different orientation where its orientation is maintained. Clamping the handlebar at this point prevents it unintentionally sliding along the angled bar. The angled bar is then reoriented, for example in the direction of arrow C in the drawings, and inserted into the fixed sleeve 38 on the desired side of the bed. Orientating the angled bar towards the head of the patient places the handlebar in arm's reach of the patient.

The pole can be adjusted along the second section of the angled bar to be moved closer or further from the patient as desired.

The angle of the handlebar may be inclined relative to the angled bar by simply pivoting the handlebar on sliding sleeve 39 and tightening a screw to clamp the inclined handlebar in position.

For safety purposes a stop 41 at the end of the third section 40 prevents the handlebar sliding off the angled bar.

FIGS. 12 to 20 illustrate a second, although not the only other, embodiment of a height adjustable bed in accordance with the invention. The bed is conceptually the same as the bed shown in FIGS. 1 to 11 and the following discussion highlights important differences in detail between the two embodiments. The same reference numerals describe the same components in both beds.

One feature of the bed shown in FIGS. 12 to 20 is the construction of the post sleeves 25 and the upper and lower support members 15, 16.

Figure 20:
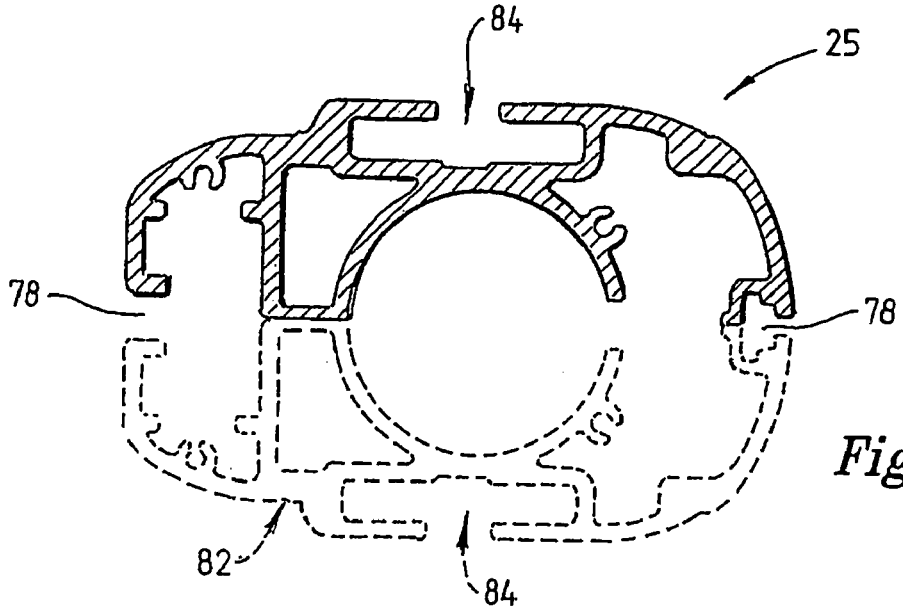
FIG. 20 is a cross-section of the sleeve of the lifting mechanism shown in FIGS. 12 to 19.

With reference to FIG. 20, each post sleeve 25 is formed from two aluminium extrusions 82 (one of which is shown in outline) having the cross section shown in FIG. 20 that are connected together as shown in FIG. 20. One particular feature of the post sleeve 25 is that it includes two opposed channels 84 that extend along the lengths of the sleeves. The channels 84 are provided to receive guide brackets 86 of the upper support member 15. Another feature of the post sleeve 25 is that it includes two further opposed channels 78 that define convenient means for attaching accessories to the sleeve.

Figure 17:
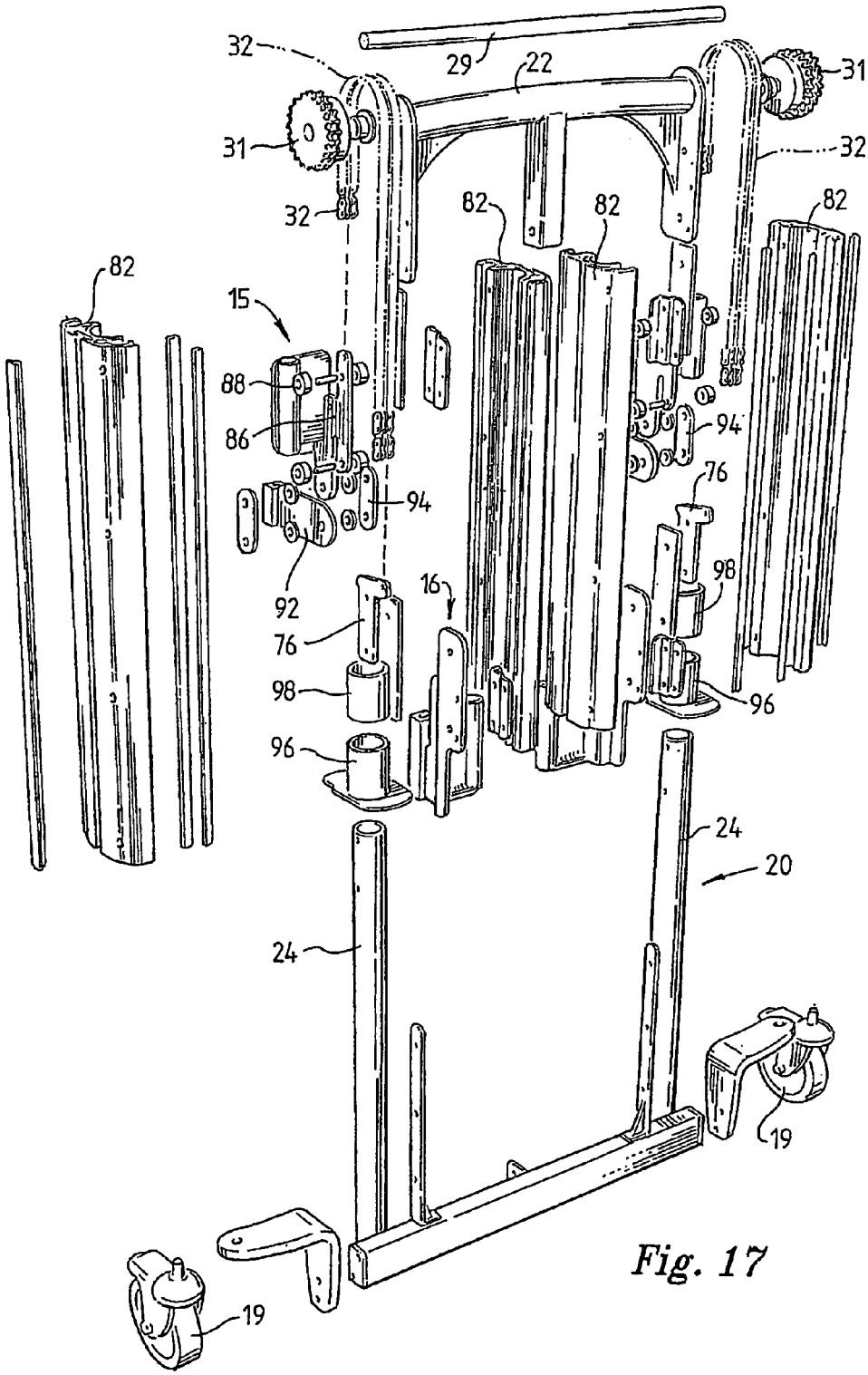
FIG. 17 is an exploded perspective view illustrating the main components of the bed head/bed end of the bed shown in FIGS. 12 to 16.
Figure 18:
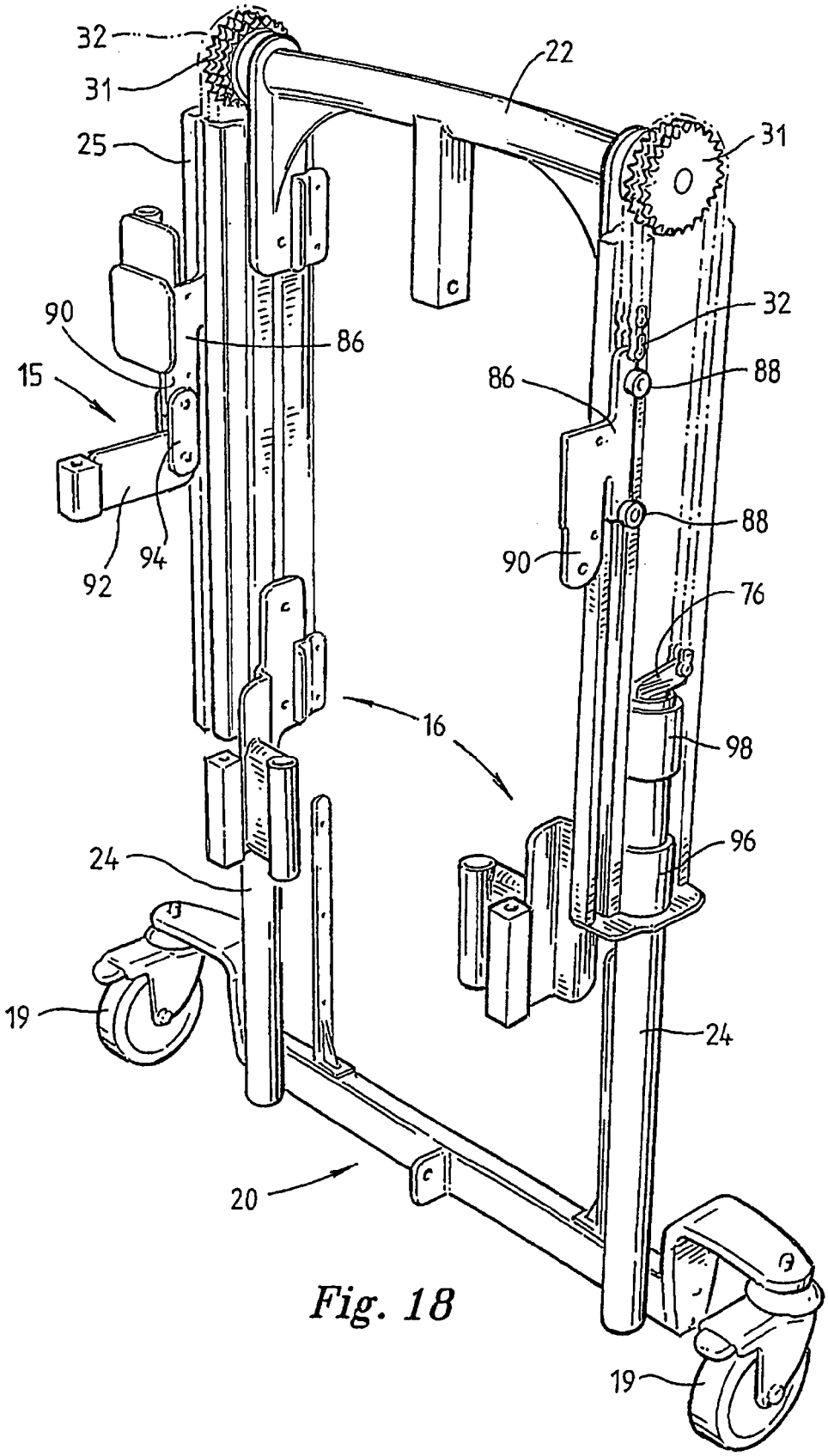
FIGS. 18 and 19 are perspective views from different positions of the bed head/bed end of the bed shown in FIGS. 12 to 17 in a raised position, with some components removed form clarity.
Figure 19:
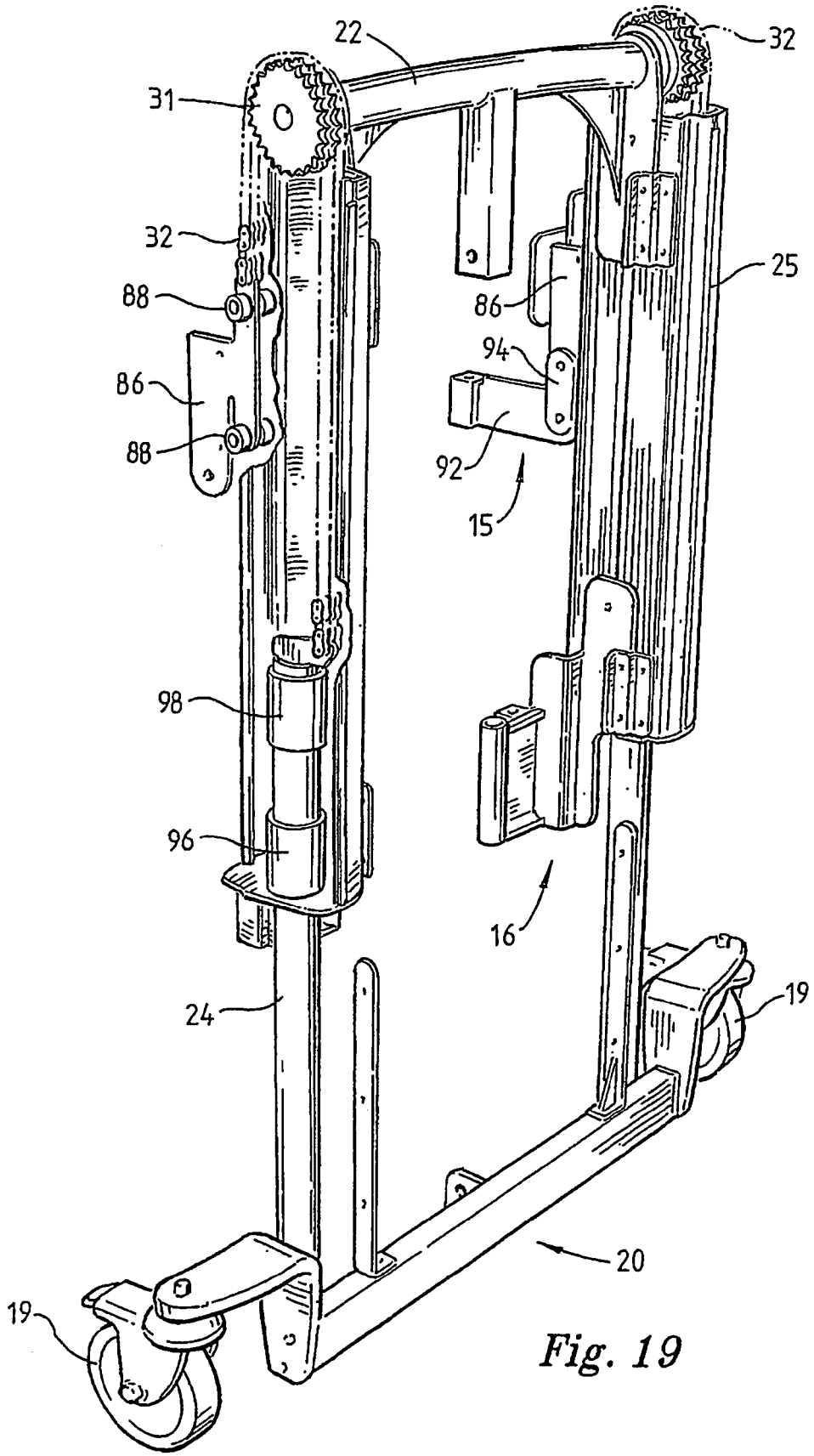

FIGS. 17 to 19 illustrate the components of the upper support member 15. As indicated above, the upper support member 15 includes a guide bracket 86. The guide bracket 86 includes rollers 88 that are formed to run in the channels 84. The guide bracket 86 also includes a downwardly extending arm 90 that forms a mounting location for an outwardly extending support arm bracket 92. The arm 90 and the support arm bracket 92 are interconnected via a link 94. The link 94 enables relative movement of the support arm bracket 92 and the bed ends to accommodate tilting movement of the mattress base.

With reference to FIGS. 17 to 19, the base posts 24 and the post sleeves 25 are interconnected by means of a lower bush 96 that is mounted to a lower part of the sleeve 25 and an upper bush 98 that is mounted to an upper part of the post 24. The locations of the bushes 96, 98 are selected so that there is a minimum spacing of 200 mm (in this embodiment) between the bushes when the sleeves 25 are in the raised position. The use of the bushes 96 and 98 and the minimum spacing of 200 mm ensures stable support for the lifting mechanisms, particularly in the raised position.

With further reference to FIGS. 17 to 19, the chain linkages 32 are connected to the base posts 24 via brackets 76 mounted to the upper end of the posts 24. This arrangement reduces the total length of the chain linkage that is required.

Figure 15:
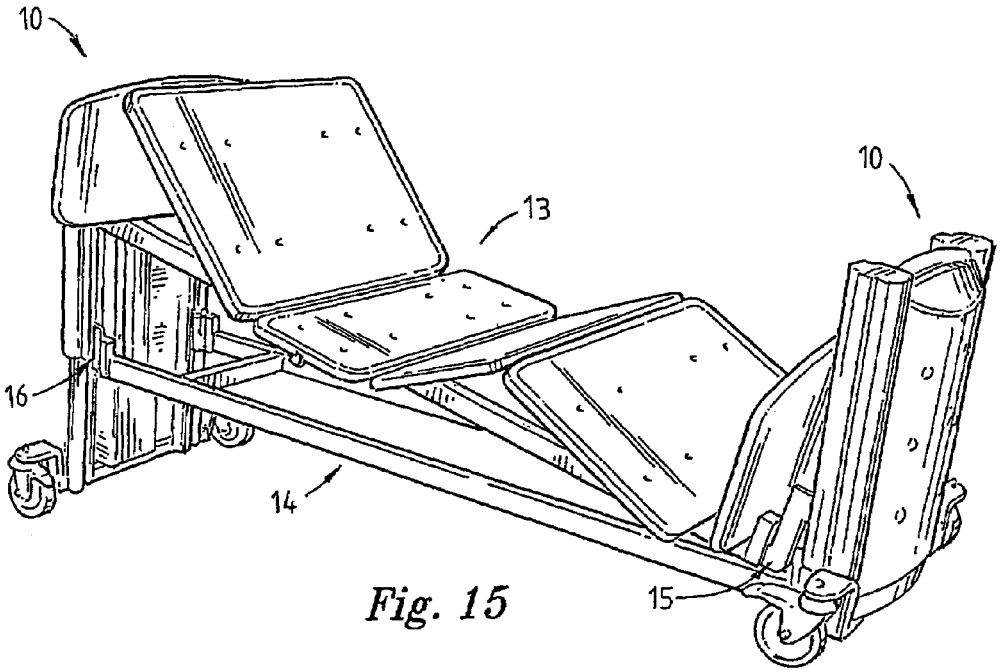
FIGS. 15 and 16 are computer generated images that illustrate two of a range of possible configurations of the mattress platform of the bed shown in FIGS. 12 to 14.
Figure 16:
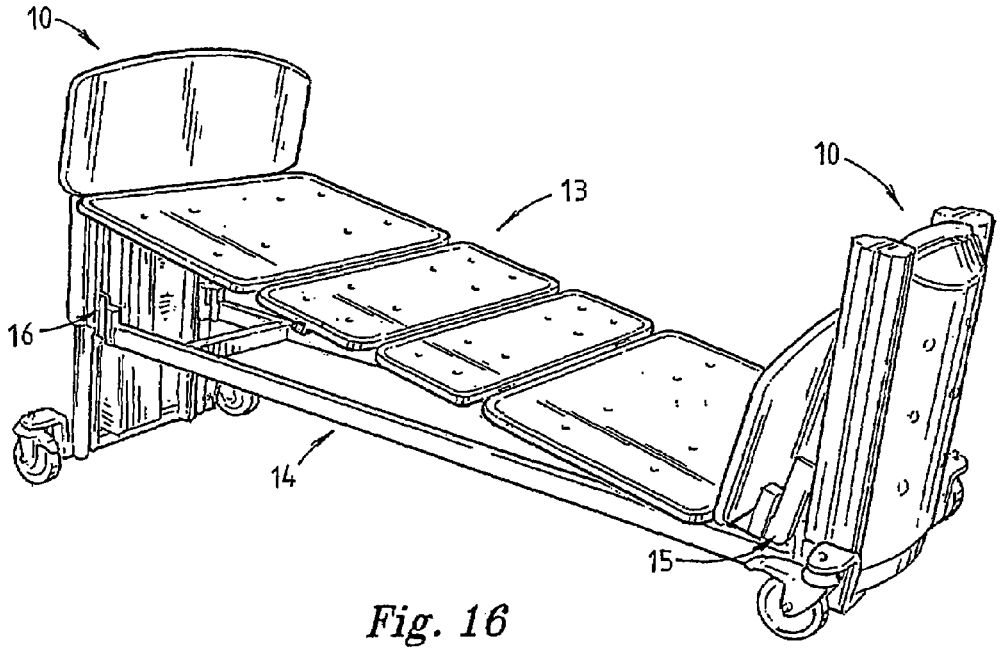

FIGS. 15 and 16 illustrate two of a range of possible orientations of the mattress base. In the arrangement shown in FIG. 15, the mattress base is in a flat configuration and is at an angle of 18° from the horizontal. In the arrangement shown in FIG. 15 the mattress base is selectively arranged to define an inclined seat with back support and leg support.

Whilst the present lifting mechanism has been described as being incorporated in a hospital bed which requires two lifting mechanisms, it is understood that it can find use in other health care equipment in individual units or multiple units and in other applications that are unrelated to health care.

Vertically moveable wheelchairs is but one alternate example of health care equipment where the present lifting mechanism may be used for raising and lowering patients.

Figure 21:
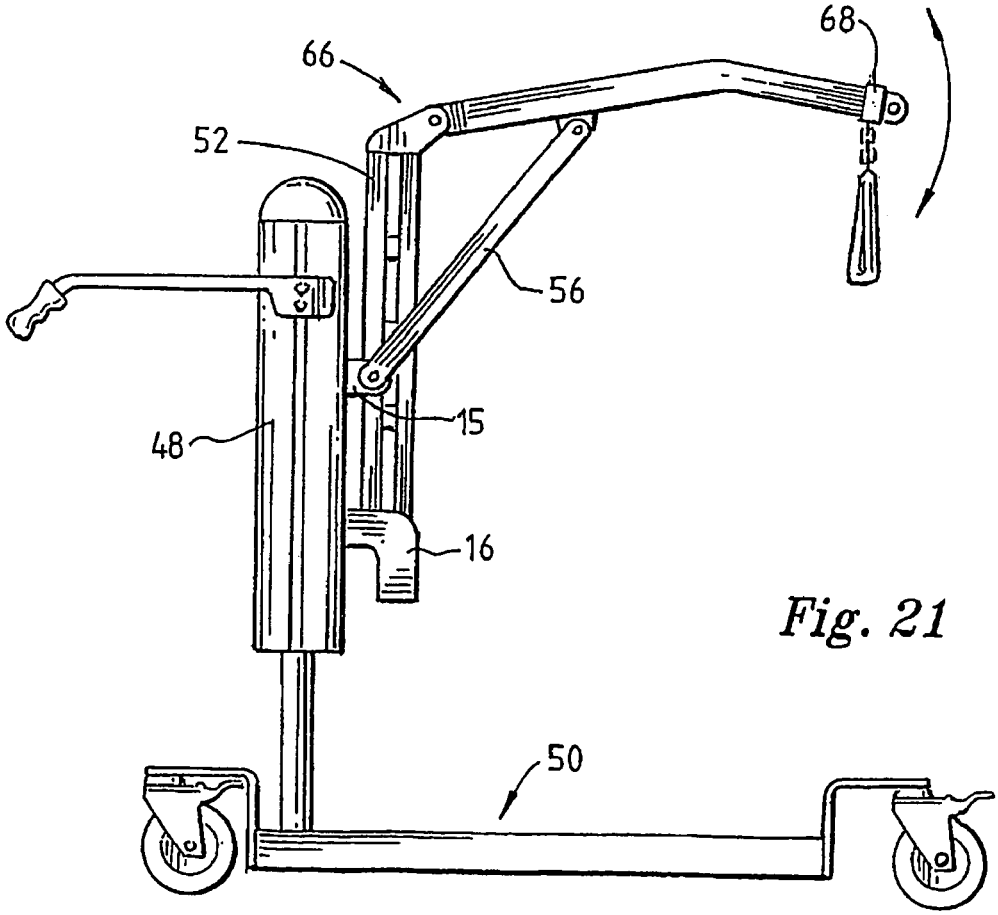
FIG. 21 is a side view of another embodiment of health care equipment incorporating a lifting mechanism in accordance with the invention.

Another example of a health care application is as a movable lifting frame for patients. FIG. 21 illustrates one embodiment of such a lifting frame.

The lifting frame shown in FIG. 21 takes advantage of the differential lifting that can be achieved by virtue of the different rates of the upward and downward movement of the upper and lower support members 15, 16. Specifically, as is described above in relation to the bed embodiments of the invention, the connection of the upper support members 15 to the base posts 24 via chain linkages 32 means that the upper support members 15 move upwardly and downwardly at twice the speed of the cross members 22 that are connected to the sleeves 25. In addition, as is described above, the connection of the lower support members 16 to the sleeves 25 means that the lower support members 16 move upwardly and downwardly at the same speed as the cross members 22 and the sleeves 25.

With reference to FIG. 21, the lifting frame includes a pedestal lifting mechanism 48 of the general type described above in relation to the bed embodiments of the invention. The lifting mechanism 48 is mounted to a base frame in the form of two spaced apart legs 50 that extend forwardly of the lifting mechanism 48 and provide a stable base for the lifting frame. The lifting frame further includes an upwardly and outwardly extending support member 66 that includes a mounting point 68 for a sling or other suitable patient support at the end of the member 66. The support member 66 has two arms, with one arm 52 extending upwardly from the lower support member 16 of the lifting mechanism 48 and the other arm 54 extending outwardly from the upper end of the arm 52. The two arms 52, 54 are pivotally connected together so that the outwardly extending arm 54 can swing upwardly and downwardly relative to the arm 52. The lifting frame further includes a cross member 56 connected at one end to the upper support member 15 and at the other end to the outwardly extending arm 56. In use, upward movement of the lifting mechanism moves the support member 66 upwardly and swings the outwardly extending arm 56 of the support member 66 upwardly. This arrangement facilitates efficient, safe and effective lifting of a patient clear of a base surface.

It will be understood to persons skilled in the art of the invention that many modifications may be made without departing from the spirit and scope of the invention.

The invention claimed is:

1. A height adjustable bed comprising:

(a) a first bed end and a second bed end, each bed end comprising a lifting mechanism, wherein said lifting mechanism comprises:

(i) a base to which at least two spaced base posts are mounted to extend upwardly;

(ii) a sleeve slidable on each base post;

(iii) a cross member extending between and fixed directly to the sleeves;

(iv) an actuator located between the base and the cross member and adapted to vertically move the cross member relative to the base;

(v) an upper support member for an object to be lifted slidingly movable along the sleeves; and (vi) a pulley provided on the cross member, the pulley supporting a chain or belt fixed at a first end to the base and at the other end to the upper support member so that, in use, as the actuator raises and lowers the cross member, the upper support member is respectively raised or lowered at a greater speed than the cross member; and (b) a mattress support provided between the first and second bed ends and mounted to each upper support member of each lifting mechanism of the first and second bed ends, wherein the mattress support is vertically movable relative to the first and second bed ends.

2. The height adjustable bed defined in claim 1 wherein the sleeves include channels and the upper support member includes guides that are received in the channels for sliding movement along the sleeves.

3. The height adjustable bed defined in claim 1 wherein the sleeves are captured in guides located on the upper support member.

4. The height adjustable bed defined in claim 1 wherein the lifting mechanism further comprises a lower support member for an object mounted to and movable with the sleeves so that, in use, as the actuator raises and lowers the cross member, the lower support member is respectively raised or lowered at the same speed as the cross member.

5. The height adjustable bed defined in claim 1 wherein the lifting mechanism includes wheels to allow the lifting mechanism to be moved from one location to another location.

6. A height-adjustable bed that includes a pair of lifting mechanisms comprising:

(a) a first bed end and a second bed end, each bed end comprising one of said pair of lifting mechanisms, wherein each of the lifting mechanisms comprises:

(i) a base to which at least two spaced base posts are mounted to extend upwardly;

(ii) a sleeve slidable on each base post;

(iii) a cross member extending between and fixed directly to the sleeves;

(iv) an actuator located between the base and the cross member and adapted to vertically move the cross member relative to the base;

(v) an upper support member slidingly movable along the sleeves; and (vi) a pulley provided on the cross member, the pulley supporting a chain or belt fixed at a first end to the base and at the other end to the upper support member so that, in use, as the actuator raises and lowers the cross member the upper support member is respectively raised or lowered at a speed that is twice the speed of the cross member; and (b) a mattress support provided between the first and second bed ends and mounted to each upper support member of each lifting mechanism of the first and second bed ends, wherein the mattress support is vertically movable relative to the first and second bed ends.

7. A height-adjustable bed defined in claim 6 wherein the sleeves include channels and the upper support member includes guides that are received in the channels for sliding movement along the sleeves.

8. A height-adjustable bed defined in claim 6 wherein the sleeves are captured in guides located on the upper support member.

9. A height-adjustable bed defined in claim 6 wherein the lifting mechanism further comprises a lower support member mounted to and movable with the sleeves so that, in use, as the actuator raises and lowers the cross member, the lower support member is respectively raised or lowered at the same speed as the cross member.

10. A height-adjustable bed defined in claim 9 wherein the upper support member is adapted to be attached to a primary patient support.

11. A height-adjustable bed defined in claim 10 wherein the patient support to which the upper support member is attached is a primary support for a patient.

12. A height-adjustable bed defined in claim 10 wherein the lower support member is adapted to be attached to a secondary patient support.

13. A height-adjustable bed defined in claim 6 wherein the secondary patient support is a lower bed support frame which adds stability to the bed by creating a box frame with the primary support and the lifting mechanisms at each end of the bed.

14. A height-adjustable bed defined in claim 13 wherein the primary and secondary patient supports are parallel.

15. A height-adjustable bed defined in claim 6 wherein the lifting mechanism ends of the bed are preferably independently operable such that one lifting mechanism may be raised to a different height to the lifting mechanism at the other end of the bed.

* * * * *

UNITED STATES PATENT AND TRADEMARK OFFICE

CERTIFICATE OF CORRECTION

PATENT NO. : 7,428,760 B2
APPLICATION NO. : 10/505810
DATED : September 30, 2008
INVENTOR(S) : McCrimmon It is certified that error appears in the above-identified patent and that said Letters Patent is hereby corrected as shown below:

Title page, Item (56) References Cited, FOREIGN PATENT DOCUMENTS, page 2, Column 1, the last reference "RU 1777861 A1 11/1992" should read
-- SU 1777861 A1 11/1992 --

Signed and Sealed this

Third Day of February, 2009

John Doll

JOHN DOLL
*Acting Director of the United States Patent and Trademark Office*